US009755338B2

(12) United States Patent
Ning

(10) Patent No.: US 9,755,338 B2
(45) Date of Patent: Sep. 5, 2017

(54) ELECTRONIC CARD CONNECTOR WITH TERMINALS HAVING SHARED SOLDERING PORTIONS

(71) Applicant: FOXCONN INTERCONNECT TECHNOLOGY LIMITED, Grand Cayman (KY)

(72) Inventor: Qiang Ning, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/797,483

(22) Filed: Jul. 13, 2015

(65) Prior Publication Data

US 2016/0013571 A1 Jan. 14, 2016

(30) Foreign Application Priority Data

Jul. 11, 2014 (CN) ..... 2014 1 0329623

(51) Int. Cl.

| | |
|---|---|
| ***H01R 12/71*** | (2011.01) |
| ***H01R 12/57*** | (2011.01) |
| ***H01R 13/24*** | (2006.01) |
| ***H01R 4/02*** | (2006.01) |

(52) U.S. Cl.

CPC ..... *H01R 12/718* (2013.01); *H01R 12/57* (2013.01); *H01R 4/02* (2013.01); *H01R 13/245* (2013.01)

(58) Field of Classification Search

CPC .... H01R 12/57; H01R 12/718; H01R 12/714; H01R 13/245; H01R 13/2442; H01R 4/02; H01R 4/023; G06K 7/0021; G06K 7/0034; G06K 7/0056; G06K 13/14

See application file for complete search history.

(56) References Cited

U.S. PATENT DOCUMENTS

| | | | | |
|---|---|---|---|---|
| 6,669,493 | B2 * | 12/2003 | Kuroda | H01R 13/629 439/157 |
| 6,739,911 | B2 * | 5/2004 | Wagatsuma | H01R 13/629 439/607.31 |
| 7,517,251 | B2 * | 4/2009 | Richter | G06K 7/0013 439/620.04 |

(Continued)

FOREIGN PATENT DOCUMENTS

| | | |
|---|---|---|
| CN | 2696157 | 4/2005 |
| CN | 201927738 | 8/2011 |

(Continued)

*Primary Examiner* — James Harvey
*Assistant Examiner* — Oscar C Jimenez
(74) *Attorney, Agent, or Firm* — Ming Chieh Chang; Wei Te Chung

(57) ABSTRACT

An electronic card connector (100) includes an insulative housing (1) defining a receiving cavity (10), a number of first contacts (21) and second contacts (22) retained in the insulative housing, and a metal sheet (20). The receiving cavity has a first space (101) and a second space (102) configured in a card-inserting direction. Each first contact has a first contacting portion (210) rising into the first space. Each second contact has a second contacting portion (220) rising into the second space and a soldering portion (222). One of the first contacts is connected with one of the second contacts via the metal sheet to share the soldering portion.

4 Claims, 5 Drawing Sheets

(56) References Cited

U.S. PATENT DOCUMENTS

| | | | | |
|---|---|---|---|---|
| 8,233,949 | B2 * | 7/2012 | Li | G06K 7/0021 455/558 |
| 8,523,614 | B2 | 9/2013 | Matsunaga | |
| 9,336,462 | B2 * | 5/2016 | Zhang | H04B 1/3816 |
| 2006/0240713 | A1 | 10/2006 | Kikuchi | |
| 2008/0274648 | A1 * | 11/2008 | Takahashi | G06K 7/0021 439/630 |
| 2011/0070760 | A1 * | 3/2011 | Zhang | G06K 7/0021 439/159 |
| 2012/0252276 | A1 | 10/2012 | Zhu et al. | |
| 2013/0237097 | A1 * | 9/2013 | Nakamura | H01R 13/64 439/633 |
| 2013/0288535 | A1 * | 10/2013 | You | H01R 24/62 439/634 |
| 2015/0056851 | A1 * | 2/2015 | Zhang | H04B 1/3816 439/527 |
| 2016/0086000 | A1 * | 3/2016 | Sarraf | G06K 7/0056 439/529 |

FOREIGN PATENT DOCUMENTS

| | | |
|---|---|---|
| CN | 202111238 | 1/2012 |
| CN | 103296518 | 9/2013 |
| CN | 103647198 | 3/2014 |

* cited by examiner

ELECTRONIC CARD CONNECTOR WITH TERMINALS HAVING SHARED SOLDERING PORTIONS

BACKGROUND OF THE INVENTION

1. Field of the Invention

The present invention relates generally to an electronic card connector, and more particularly to an electronic card connector with terminals having shared soldering portions.

2. Description of Related Arts

U.S. Patent Application Publication No. 2012/0252276 discloses an electronic card connector for receiving either a first card or a second card at a time. The electronic card connector includes an insulative housing and a plurality of contacts retained in the housing. The contacts include a plurality of first contacts for engaging with the first card, and a plurality of second contacts cooperating with the first contacts for engaging with the second card. The first contacts and the second contacts have retaining portions fixed with the housing, contact portions protruding from the retaining portions into a card inserting slot, and soldering portions extending beyond the housing from the retaining portions. The contact portions of the first contacts and the contact portions of the second contacts are positioned at different position along a front-to-back direction. At least one of the first contacts and a corresponding one of the second contacts share a same soldering tail.

An electronic card connector with terminals having shared soldering portions is desired.

SUMMARY OF THE INVENTION

Accordingly, an object of the present invention is to provide an electronic card connector having shared soldering portions.

To achieve the above object, an electronic card connector comprises: an insulative housing defining a receiving cavity, the receiving cavity has a first space and a second space configured in a card-inserting direction; a plurality of first contacts and second contacts retained in the insulative housing, each first contact has a first contacting portion rising into the second space, each second contact has a second contacting portion rising into the first space and a soldering portion; and a metal sheet connecting one of the first contacts with one of the second contacts to share the soldering portion.

DETAILED DESCRIPTION OF THE PREFERRED EMBODIMENT

Figure 1:
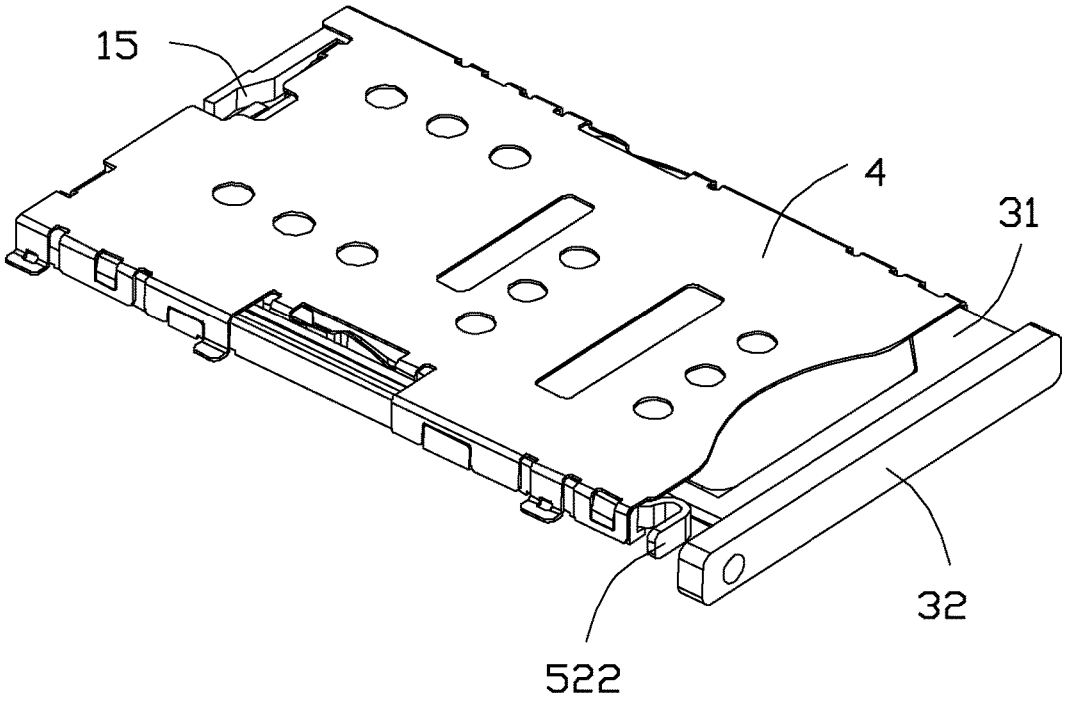
FIG. 1 is a perspective, assembled view of an electronic card connector.

Reference will now be made in detail to the preferred embodiment of the present invention.

Referring to FIGS. 1 to 5, an electronic card connector 100 of the present invention includes an insulative housing 1, a plurality of terminals 2 and a switch 6 affixed to the insulative housing 1, a drawer 3 slidable in the insulative housing 1, a shielding shell 4 attached to the insulative housing 1 and defining a receiving cavity 10 therebetween, and an ejector 5 located in the insulative housing 1 and received in the receiving cavity 10. The electrical connector 100 defines a card-inserting direction, a transverse direction perpendicular to the card-inserting direction, a front end, and a rear end. The drawer 3 is used for carrying a first card 200 and/or a second card 300, i.e., one at a time or both at the same time. The receiving cavity 10 is configured with a first space or contacting region 101 and a second space or contacting region 102 in the card-inserting direction.

Figure 3:
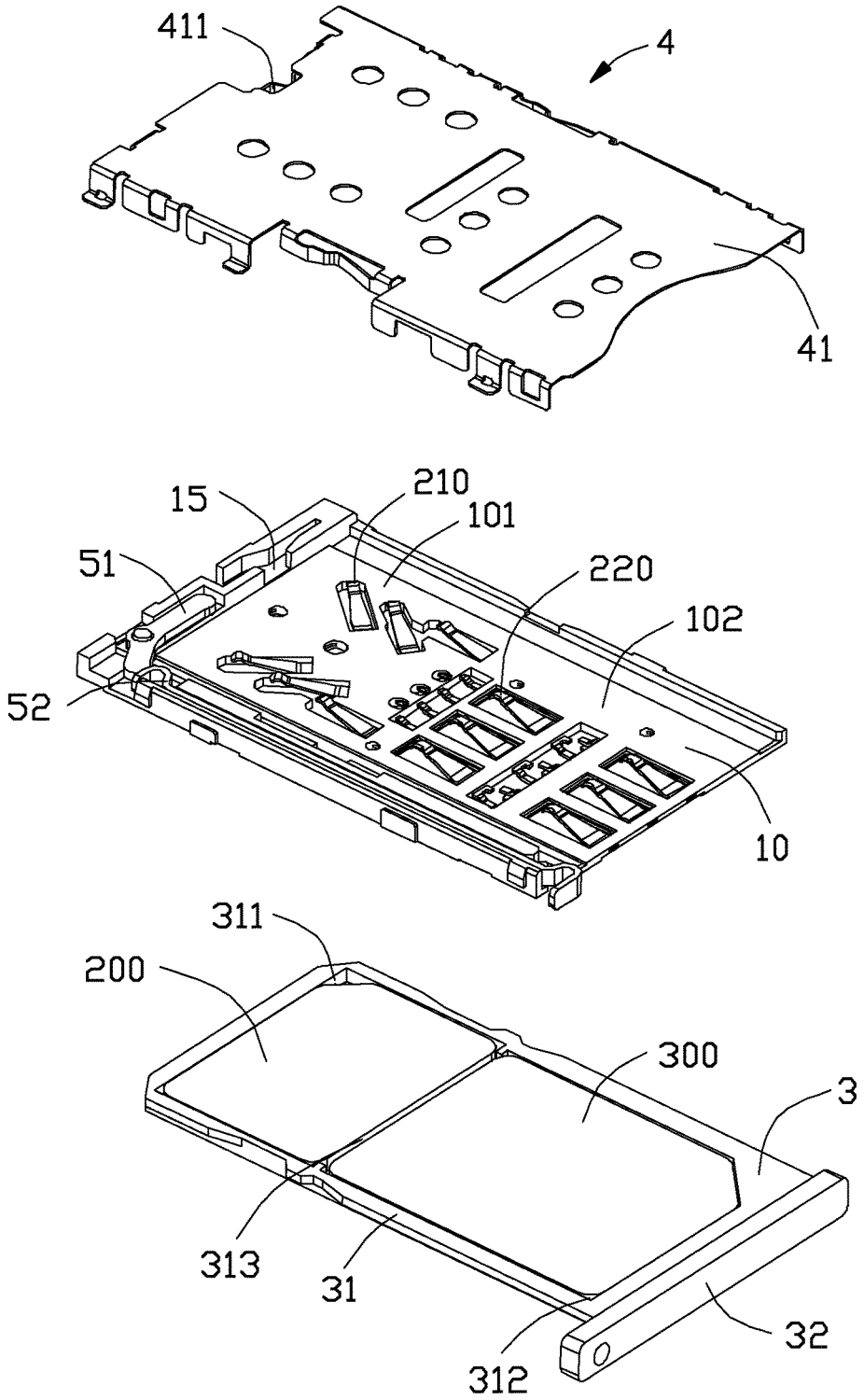
FIG. 3 is a perspective, exploded view of the electrical card connector assembled with the first and second cards.
Figure 4:
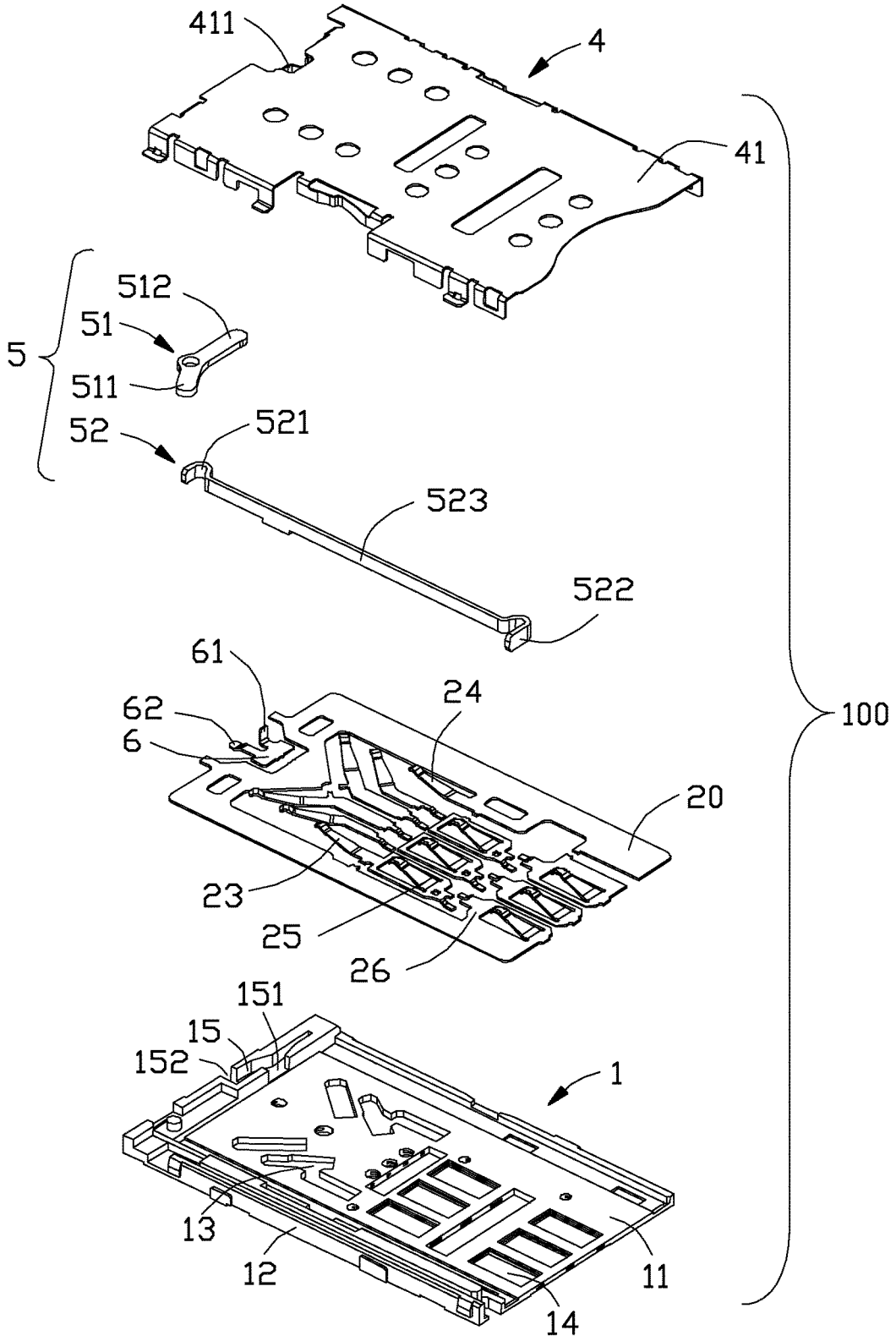
FIG. 4 is a perspective, exploded view of the electronic card connector omitting a tray.
Figure 5:
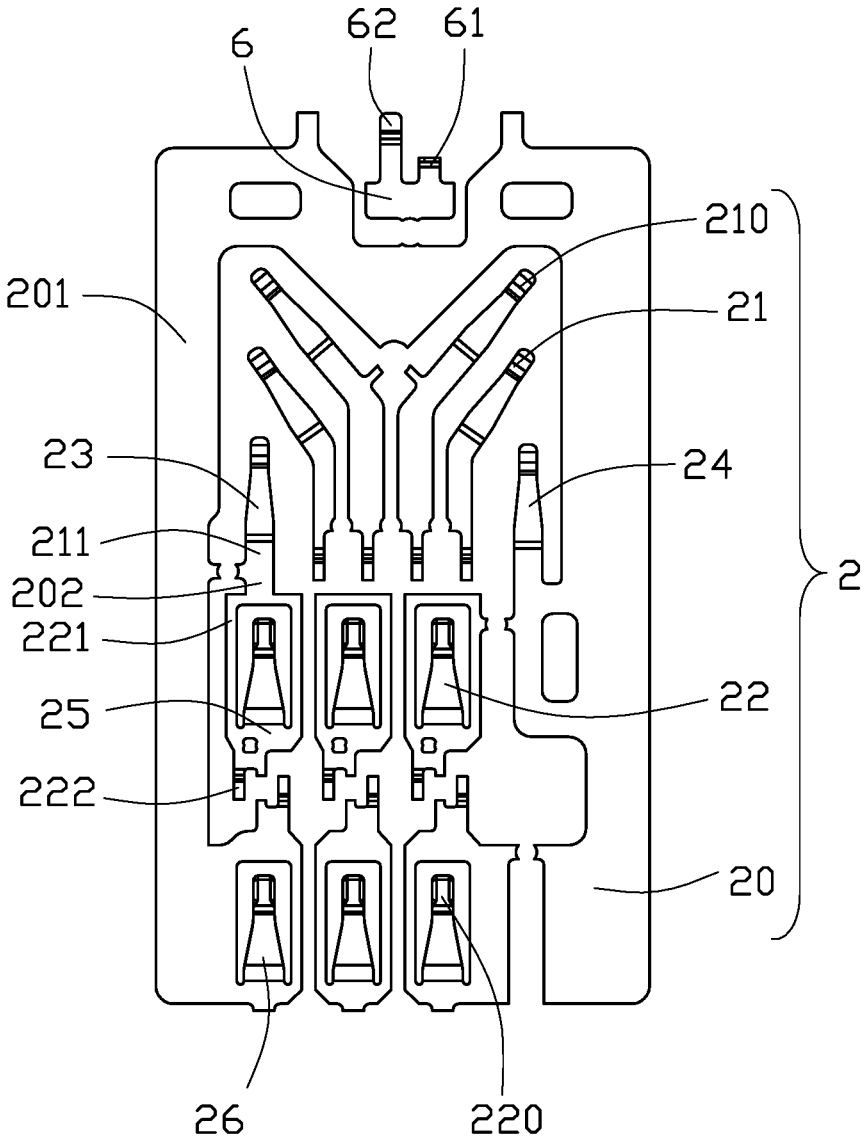
FIG. 5 is a top plan view of all terminals and switch of the electronic card connector.

Referring to FIGS. 3 and 4, the insulative housing 1 includes a base portion 11, a side portion 12 located in two sides of the base portion 11, a number of first grooves 13 and a number of second grooves 14 located at the base portion 11 in the card-inserting direction, and a receiving slot 15 located at a front end of the base portion 11. The first grooves 13 are arranged in two rows and inclined laterally. The second groove 14 are arranged in two rows and the two rows are paralleled to each other. The receiving slot 15 includes a first opening 151 communicated with the receiving cavity 10 and a second opening 152 located at a front end thereof.

The terminals 2 include a number of first contacts 21 received in the first grooves 13, a number of the second contacts 22 received in the second grooves 14, and a metal sheet 20 connecting with the first contacts 21 and the second contacts 22 outside. Each first contact 21 includes a main body 211 shaped as a strip and a first contacting portion 210 rising into the first space 101 to connecting with the first card 200. Each second contact 22 includes a contacting portion 220 rising into the second space 102 for connecting with the second card 300, a frame portion 221, and a soldering portion 222 connecting with the frame portion 221. The first contacts 21 include a pair of first lateral contacts 23 and 24, and the second contacts 22 include a pair of second lateral contacts 25 and 26 located in a line along a card-inserting direction with one of the first lateral contacts 23 and 24. The orientation of the first contacts 21 is perpendicular to that of the second contacts 22. In this embodiment, the second lateral contacts 25 and 26 are located in a row with the first lateral contact 23 in left side. The second lateral contact 26 is located at the back in the two rows. The main body 211 of the first lateral contact 23 is connected, by a metal part 202, with the frame portion 221 of the second lateral contact 25 to share the soldering portion 222 of the second lateral contact 25. The first lateral contact 24 is connected with the frame portion 221 of the second lateral contact 26 via a metal part 201 of the metal sheet 20 to share the soldering portion 222 of the second lateral contact 26.

Referring to FIG. 3, the drawer 3 includes a tray body 31 and an operating portion 32 connected with the tray body 31. The tray body 31 has a first receiving room 311 and a second receiving room 312 located at the same side, and a rib 313 separating the first receiving room 311 and the second receiving room 312. The first receiving room 311 is used to receive the first card 200 and the second receiving room 312 is used to receive the second card 300.

Figure 2:
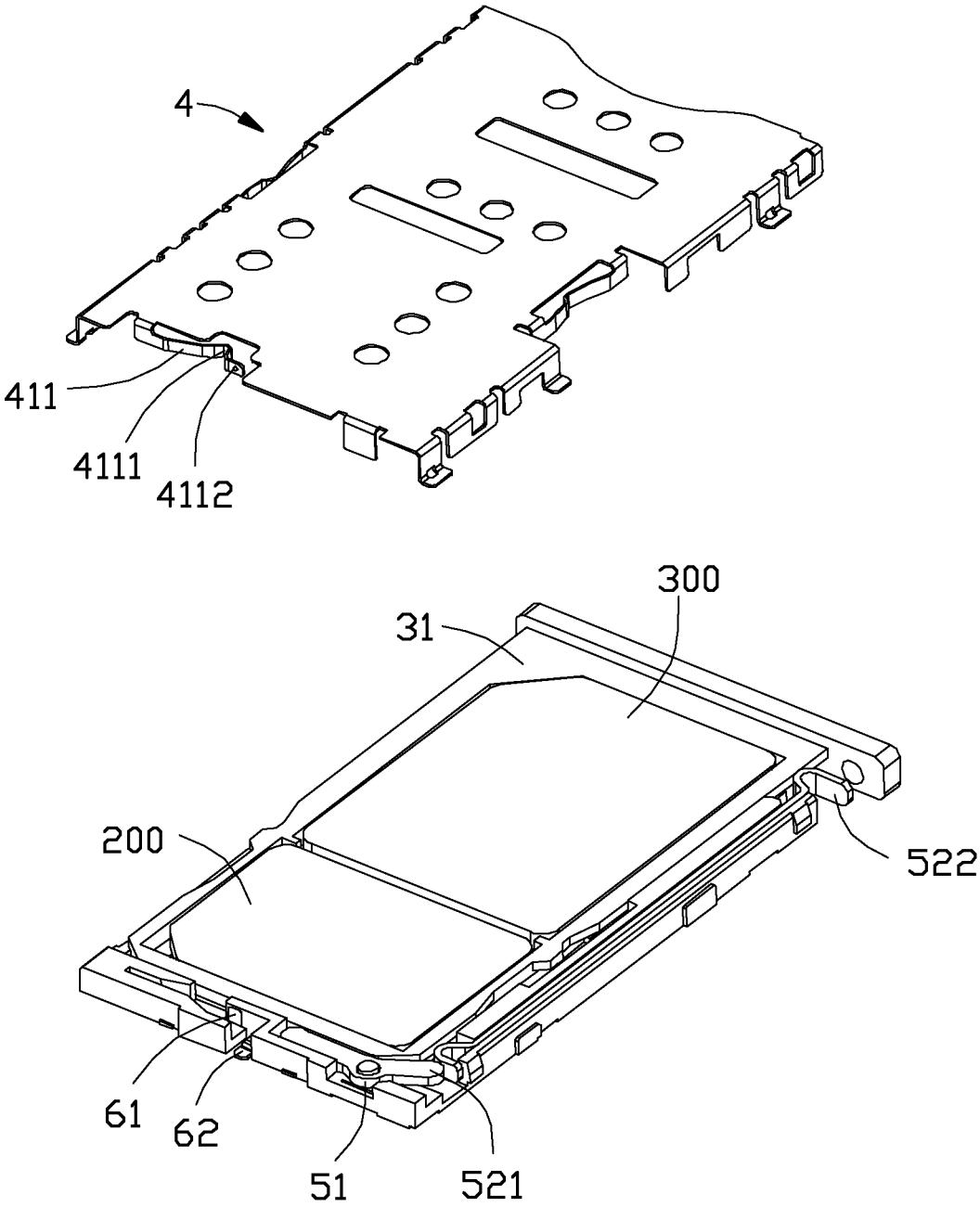
FIG. 2 is a perspective, partly exploded view of the electrical card connector assembled with a first card and a second card.

Referring to FIGS. 2 to 4, the metal shell 4 includes a top wall 41 and a pair of side walls 42 extending downwardly from the top wall 41. The top wall 41 has a detecting part 411 located at a front end thereof and extending downwardly. The detecting part 411 cooperates with the switch 6 and includes a projecting part 4111 rising into the receiving cavity 10 and an acting part 4112 connected with the projecting part 4111.

The ejecting mechanism 5 is formed with a cam 51 and a lever 52 cooperated with the cam 51. The cam 51 includes a rotating arm 511 and a pushing arm 512. The lever 52, received in the side portion 12, is formed with a first hook 521 linked with the arm 511, a second hook 522 located at a rear end thereof, and a connecting part 523 connected with the first hook 521 and the second hook 522.

The switch 6 includes a reacting part 61 bent and extending upwardly and a soldering leg 62. The reacting part 61 is received in the receiving slot 15 and resisted against by the acting part 4112 normally. When the drawer 3 is inserted into the receiving cavity 10, the projecting part 4111 of the detecting part 411 is resisted by the drawer 3 to separate the projecting part 4111 from the reacting part 61. After the drawer 3 leaves the receiving cavity 10, the detecting part 411 is released by the drawer 3 to contact the reacting part 61 with the projecting part 4111.

The preferred embodiment of the present invention is that the first lateral contact 23; 24 of the first contacts 21 and the second lateral contact 25; 26 of the second contacts 22 share the same soldering portion or portions to attain a simple structure.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical card connector comprising:

an insulative housing defining a card receiving cavity with a first contacting region and a second contacting region essentially spaced from each other without overlapping and mutually exclusively used;

said card receiving cavity defining a card insertion direction and a transverse direction perpendicular to each other;

a plurality of first contacts and a plurality of second contacts stamped from a same metal sheet, the first contacts having first contacting sections extending into the first contacting region and the second contacting have second contacting sections extending into the second contacting region, all said first contacts and all said second contacts being stamped from a same metal sheet;

an amount of the first contacting sections being six in a 3×2 matrix with two along the transverse direction and three along the card insertion direction; and another amount of the second contacting sections being six in a 2×3 matrix with three along the transverse direction and two along the card insertion direction; wherein two of the first contacting sections of the first contacts aligned with each other in the transverse direction are respectively electrically connected to corresponding two of the second contacting sections of the second contacts aligned with each other in the card insertion direction via two metal parts which are also stamped from said same metal sheet.

2. The electrical card connector as claimed in claim 1, wherein each of said two of the second contacts is equipped with a corresponding soldering section while each of said two of the first contacts is not equipped with any soldering section.

3. The electrical card connector as claimed in claim 2, wherein the soldering sections of said two of the second contacts are arranged aligned with each other in the transverse direction.

4. The electrical card connector as claimed in claim 1, wherein the second contacting sections of the two of said second contacts and the first contacting section of one of said two of the first contacts are aligned with one another along the card insertion direction, and one of said two of said second contacts neighboring said one of said two of the first contacts is electrically connected to each other via the metal part.

* * * * *